US011383968B2

(12) United States Patent
Park et al.

(10) Patent No.: US 11,383,968 B2
(45) Date of Patent: Jul. 12, 2022

(54) PORTABLE CONTAINER WITH REFILL STRUCTURE

(71) Applicant: PANGRAM Co., Ltd, Incheon (KR)

(72) Inventors: Nam Joo Park, Siheung-si (KR); Jae Sang Park, Incheon (KR)

(73) Assignee: PANGRAM CO., LTD, Incheon (KR)

( * ) Notice: Subject to any disclaimer, the term of this patent is extended or adjusted under 35 U.S.C. 154(b) by 0 days.

(21) Appl. No.: 17/083,831

(22) Filed: Oct. 29, 2020

(65) Prior Publication Data

US 2021/0139311 A1 May 13, 2021

(30) Foreign Application Priority Data

Nov. 7, 2019 (KR) ..... 10-2019-0141710

(51) Int. Cl.
*B67D 7/02* (2010.01)
*B05B 11/00* (2006.01)

(52) U.S. Cl.
CPC ..... *B67D 7/0294* (2013.01); *B05B 11/0056* (2013.01); *B05B 11/30* (2013.01); *B67D 7/0277* (2013.01)

(58) Field of Classification Search
CPC ..... B65D 83/0005; B65D 21/086; B05B 11/0056
USPC ..... 141/23–26, 113–114
See application file for complete search history.

(56) References Cited

U.S. PATENT DOCUMENTS 6,056,164 A * 5/2000 Wakayama ..... B65D 83/0005 222/327
6,537,257 B1 * 3/2003 Wien ..... A61M 5/3202 604/198
8,695,896 B2 * 4/2014 Tu ..... B05B 11/0035 239/333
2005/0284891 A1 * 12/2005 Ramet ..... B05B 11/3023 222/321.7
2014/0137983 A1 * 5/2014 Tu ..... B05B 11/0056 141/113

FOREIGN PATENT DOCUMENTS

EP 2 572 797 A1 3/2013

* cited by examiner

*Primary Examiner* — Timothy P. Kelly
(74) *Attorney, Agent, or Firm* — Paratus Law Group, PLLC

(57) ABSTRACT

Disclosed is a portable container with a refill structure, which includes: first and second containers that are open towards each other and form a contents receptacle space by being inserted in a watertight and variable way and communicating with each other; a one-way valve attached to the first container to allow the contents to be introduced; and a pump unit attached to the second container to release the contents held in the receptacle space through a nozzle. A negative pressure is generated in the receptacle space by pulling out the first and second containers in a watertight way.

14 Claims, 10 Drawing Sheets

*-Prior Art-*

*-Prior Art-*

*-Prior Art-*

PORTABLE CONTAINER WITH REFILL STRUCTURE

CROSS-REFERENCE TO PRIOR APPLICATION

This application claims priority to and the benefit of Korean Patent Application No. 10-2019-0141710 filed on Nov. 7, 2019, which is hereby incorporated by reference in its entirety.

BACKGROUND

The present disclosure relates to a portable container, and more particularly, to a portable container with a refill structure that allows a user to refill the container with contents as much as they want and carry it around by using a negative pressure.

If a user is about to carry an expensive liquid such as perfume or a type of liquid that requires only a tiny amount for each application and use it later, the user will need a refill container to where they can transfer a bit of the liquid from the main bottle for later use.

Notably, refill containers are often used to hold perfume P, as illustrated in FIG. 1. FIG. 1 depicts a main bottle M of perfume P and an example of a typical refill container.

By the way, perfumes P or other expensive liquids are usually aromatic and therefore very volatile and expensive, which addresses a few problems. Firstly, large quantities of liquid can be spilled when transferring the liquid to a refill container. Secondly, the liquid needs to be transferred with the spray pump closed, in order to prevent the liquid from evaporating, and therefore the user will have to spray the liquid into the spray pump numerous times, which inevitably involves quite repetitive work, and, worse, the user will not be able to get a desired amount of liquid transferred to the refill container just by pumping, thus making the work of transferring the liquid even harder. Thirdly, repeating the pumping action several tens of or several thousands of times may break the spray pump of the main bottle M.

In this regard, much research and development are being conducted on devices for transferring liquid from a main bottle M to a refill container.

FIG. 2 shows a refill device that is conventionally used. This device allows for transferring liquid by a pumping action that occurs when a ball-like tube is repeatedly pressed.

However, when refilling the device of FIG. 2, a considerable amount of liquid may be blown away or spilled and stuck around the pipe in the process of dispensing the liquid into a refill container through a pipe at the outlet of the device. Also, the pipe has to be inserted into the refill container as shown in FIG. 2, which inevitably requires opening the refill container. Thus, a significant amount of liquid may evaporate and be lost in the refill process, and the liquid left in the tube after refilling cannot be used and should be discarded.

Due to this problem, a micro motor pump 2 for transferring liquid to a refill container 1, as shown in FIG. 3, was developed. However, it costs too high to manufacture a refill container or refill device with such micromini motorized equipment, making it not readily available to the public.

PRIOR ART DOCUMENTS

[Patent Document]

European Patent Publication No. EP02572797 B1

SUMMARY

In view of this, an aspect of the present disclosure is to provide a portable container with a refill structure that minimizes the amount of evaporation or loss while transferring liquid, makes the transfer of a liquid very quick and easy, and is cheap to manufacture, and, therefore, available to anyone.

An exemplary embodiment of the present disclosure provides a portable container with a refill structure, the portable container comprising: first and second containers that are open towards each other and form a contents receptacle space by being inserted in a watertight and variable way and communicating with each other; a one-way valve attached to the first container to allow the contents to be introduced; and a pump unit attached to the second container to release the contents held in the receptacle space through a nozzle, wherein a negative pressure is generated in the receptacle space by pulling out the first and second containers in a watertight way.

The first and second containers may generate a positive pressure in the receptacle space by being inserted in a watertight way after the introduction of the contents.

An inner container, which is one of the first and second containers that is attached to the inside in a watertight way, may comprise a locking protrusion protruding toward an outer container attached to the outside in a watertight way.

The outer container may further comprise a moving guide having the shape of a longitudinal groove to guide the movement of the locking protrusion included in the outer surface of the inner container.

The outer container may comprise an assembly guide that is formed toward an opening inside, in order to insert the locking protrusion when being attached to the inner container.

The moving guide may comprise: a guide member formed in the shape of a straight line in the direction in which the inner or outer container is pulled out or inserted; and a negative pressure fixing guide member formed in a curve along a given length from an end of the guide member.

The moving guide may allow the locking protrusion to slide into the negative pressure fixing guide member via the guide member and fix the generated negative pressure.

The moving guide may comprise: a guide member formed in the shape of a straight line in the direction in which the inner or outer container is pulled out or inserted; and a positive pressure fixing guide member formed in a curve along a given length from an end of the guide member.

The moving guide may allow the locking protrusion to slide into the positive pressure fixing guide member via the guide member and fix the generated positive pressure.

The moving guide may comprise: a guide member formed in the shape of a straight line in the direction in which the inner or outer container is pulled out or inserted; a negative pressure fixing guide member formed in a curve on the top of the guide member; and a positive pressure fixing guide member formed in a curve on the bottom of the guide member.

The first and second containers may be refilled by the generated negative pressure by locking the locking protrusion to the negative pressure fixing guide member, fix the generated positive pressure by locking the locking protrusion to the positive pressure fixing guide member after refiling, and spray the introduced refill contents by the operation of the pump unit.

The one-way valve may protrude outward from the first container and be connected to a main body stem holder to let in the refill contents stored in the refill contents storage container.

The portable container may further comprise a watertight sealing member included between the first container and the second container to prevent leaks of the refill contents by a watertight seal.

Another exemplary embodiment of the present disclosure provides a portable container with a refill structure, the portable container comprising first and second containers that are held together to form a watertight seal and open towards each other, one of which forms a receptacle space for holding contents, and the other one is moved in one direction to generate a negative pressure in the receptacle space and then moved in the opposite direction after refilling with the contents to generate a positive pressure in the receptacle space, wherein an inner container, which is one of the first and second containers, comprises a locking protrusion protruding toward an outer container, which is the other one of the first and second containers, and the outer container comprises a moving guide having the shape of a longitudinal groove to guide the movement of the locking protrusion on the outer surface of the inner container, wherein the generated negative or positive pressure is fixed by locking the locking protrusion and the moving guide together.

The disclosed technology may have the following effects. However, this does not mean that a specific embodiment should include all or only these effects, and the scope of the disclosed technology should not be understood as being limited thereto.

A portable container with a refill structure according to an exemplary embodiment of the present disclosure is advantageous in that it minimizes the amount of evaporation or loss while transferring liquid, makes the transfer of a liquid very quick and easy, and is cheap to manufacture, and, therefore, available to anyone.

A portable container with a refill structure according to an exemplary embodiment of the present disclosure allows for refilling with a liquid from a main bottle, thus preventing damage to the main bottle.

DETAILED DESCRIPTION

Figure 1:
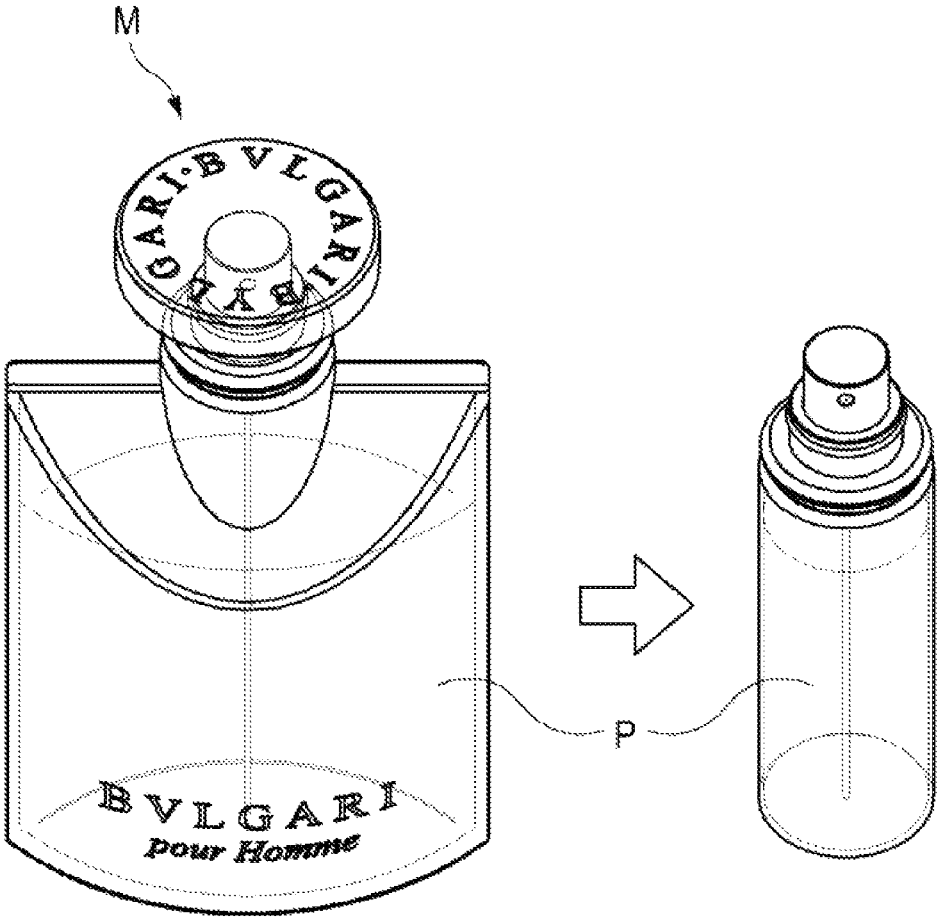
FIG. 1 is a view depicting a typical perfume bottle and a typical refill container.
Figure 2:
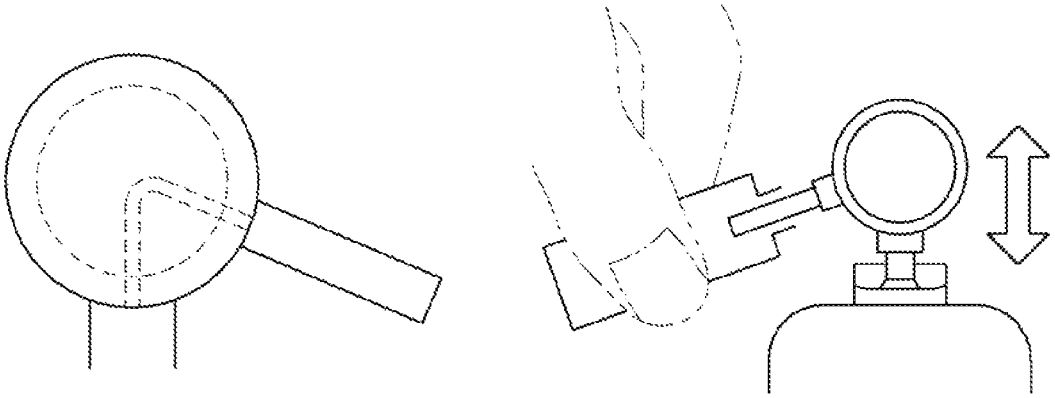
FIG. 2 is a view depicting a refill device that is conventionally used.
Figure 3:
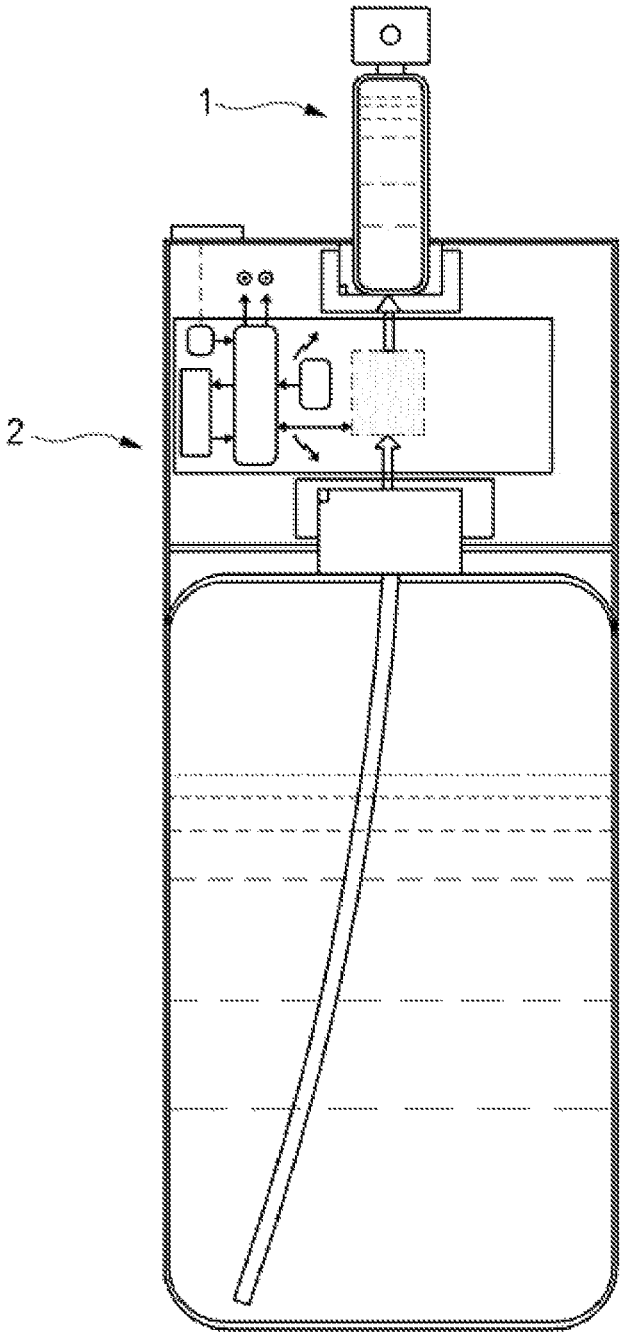
FIG. 3 is a front cross-sectional view depicting an example of a conventional refill device.

Explanation of the present disclosure is merely embodiments for structural or functional description, so the scope of the present disclosure should not be construed to be limited to the embodiments explained in the embodiment. That is, since the embodiments may be implemented in several forms, it should also be understood that the scope of the present disclosure includes equivalents able to realize its technical idea. In addition, it does not mean that a specific embodiment embraces all the purposes or effects suggested in the present disclosure or embraces only such effects, and therefore, it should be understood that the scope of the present disclosure is not limited thereto.

Meanwhile, terms used in the following description need to be understood as below. Terms such as 'first', 'second', etc., may be used to describe various components, but the components are not to be construed as being limited to the terms. The terms are used only to distinguish one component from another component. For example, the 'first' component may be named the 'second' component and the 'second' component may also be similarly named the 'first' component.

It is to be understood that when one element is referred to as being "connected to" or "coupled to" another element, it may be connected directly to or coupled directly to another element or be connected to or coupled to another element, having the other element intervening therebetween. On the other hand, it is to be understood that when one element is referred to as being "connected directly to" or "coupled directly to" another element, it may be connected to or coupled to another element without the other element intervening therebetween. Other expressions describing a relationship between components, that is, "between", "directly between", "neighboring to", "directly neighboring to" and the like, should be similarly interpreted.

Terms used in the present specification are used only in order to describe specific exemplary embodiments rather than limiting the present disclosure. Singular forms are intended to include plural forms unless the context clearly indicates otherwise. It will be further understood that the terms "comprises" or "have" used in this specification, specify the presence of stated features, steps, numerals, operations, components, parts, or a combination thereof, but do not preclude the presence or addition of one or more other features, numerals, steps, operations, components, parts, or a combination thereof.

Identification symbols (e.g., a, b, c, etc.) of individual steps are used for convenience of description and do not describe a sequence of the steps. The individual steps may be performed in a sequence different from a described sequence unless a specific sequence is clearly described in the context. In other words, the steps may be performed in the described sequence, performed substantially at the same time, or performed in a reverse sequence.

Unless indicated otherwise, it is to be understood that all the terms used in the specification including technical and scientific terms have the same meaning as those that are understood by those who skilled in the art. It must be understood that the terms defined by the dictionary are identical with the meanings within the context of the related art, and they should not be ideally or excessively formally defined unless the context clearly dictates otherwise.

Figure 4:
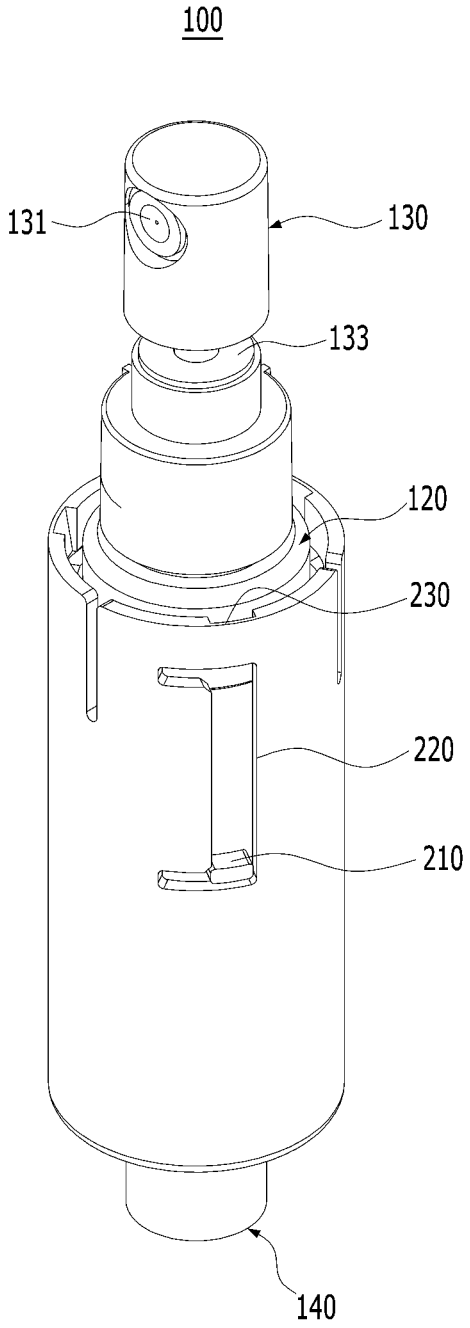
FIG. 4 is a perspective view depicting a portable container with a refill structure according to one exemplary embodiment of the present disclosure.
Figure 5:
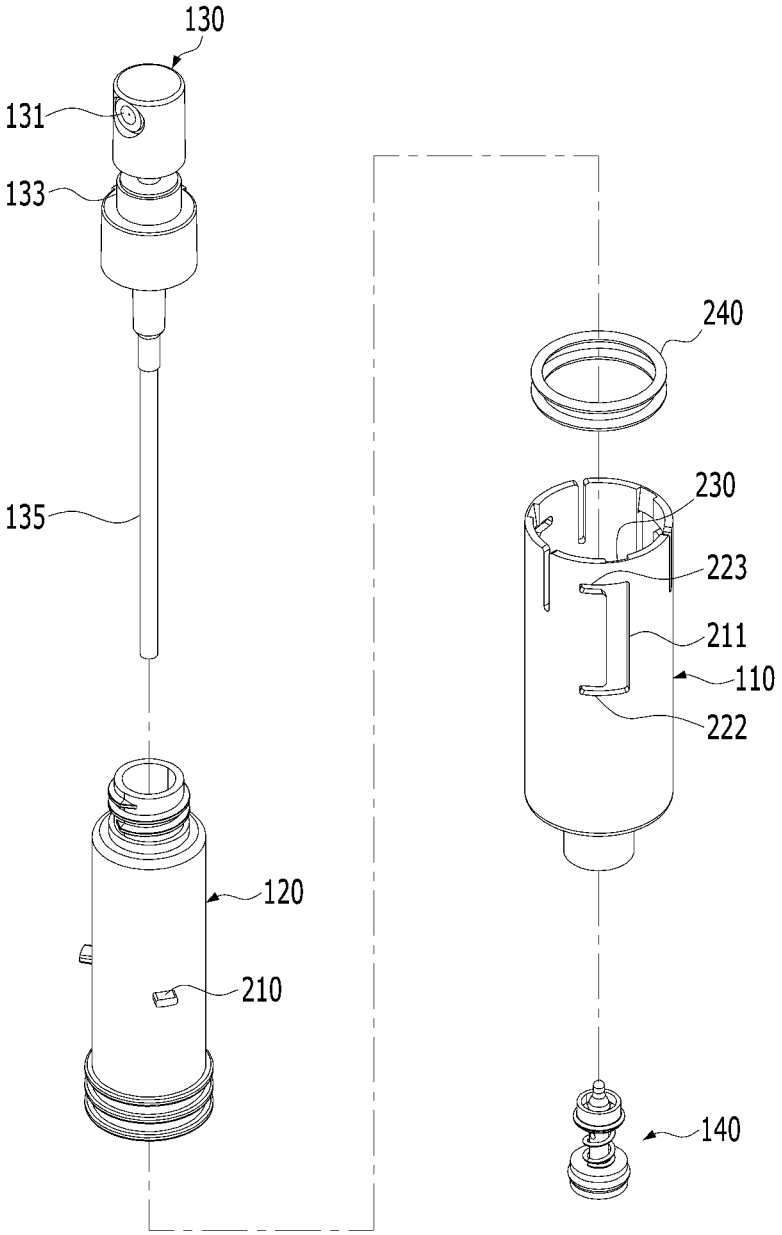
FIG. 5 is an exploded perspective view depicting the portable container of FIG. 4.
Figure 6:
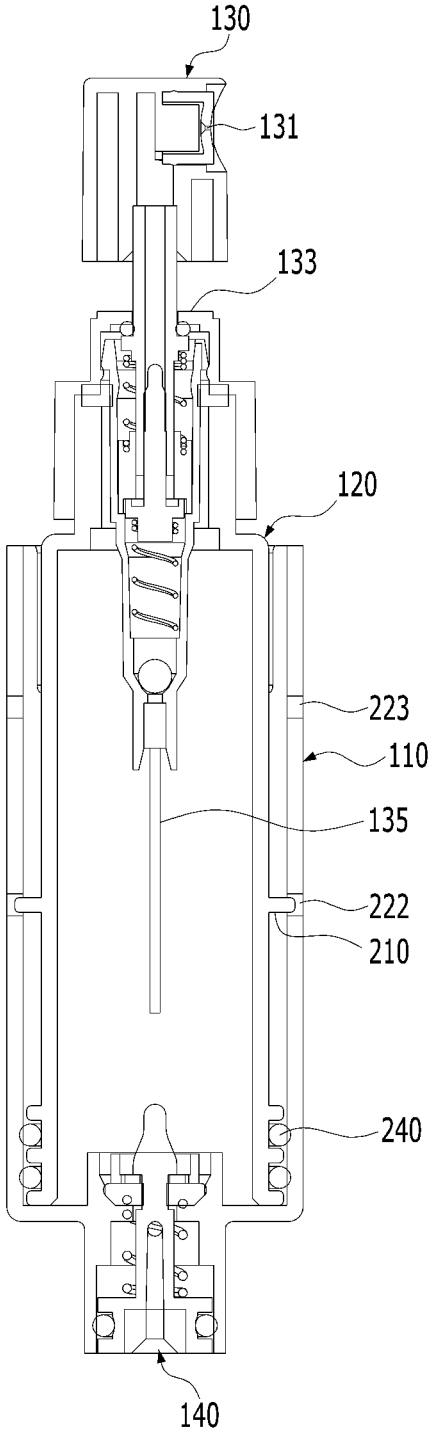
FIG. 6 is a front cross-sectional view depicting the portable container of FIG. 4.
Figure 7:
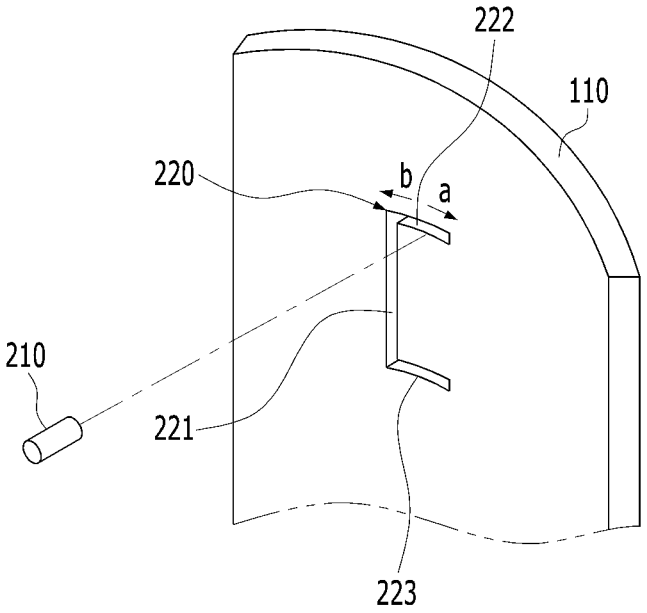
FIGS. 7 and 8 are views depicting examples of a moving guide shown in FIG. 4.
Figure 8:
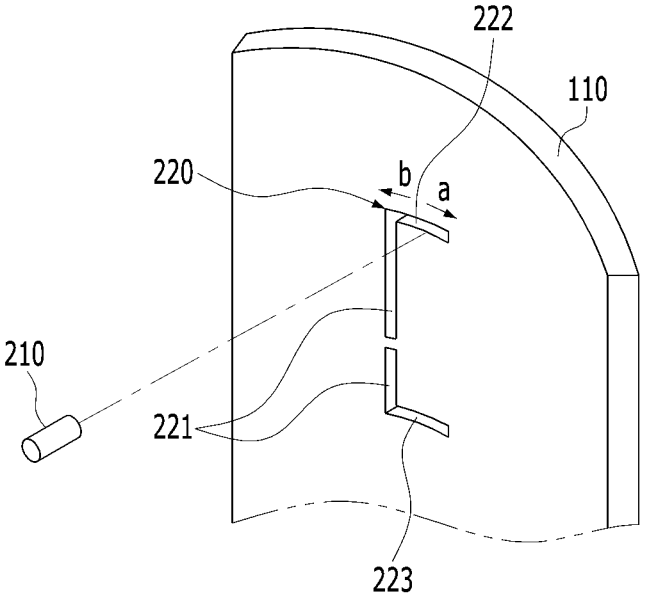

FIG. 4 is a perspective view depicting a portable container with a refill structure according to one exemplary embodiment of the present disclosure. FIG. 5 is an exploded perspective view depicting the portable container of FIG. 4. FIG. 6 is a front cross-sectional view depicting the portable container of FIG. 4. FIGS. 7 and 8 are views depicting examples of a moving guide shown in FIG. 4.

Referring to FIGS. 4 to 8, the portable container 100 may comprise a first container 110, a second container 120, a pump unit 130, and a one-way valve 140.

The portable container 100 according to one exemplary embodiment may apply to any construction as long as it holds a liquid that is to be carried around and dispensed for use—for example, it may be a container with a liquid perfume refill structure, used for getting a liquid perfume from a relatively large-capacity, main bottle to carry and apply it later. The large-capacity main bottle is bulky and heavy and is not easy to carry around for later use. Also, the user will want to spray the perfume again after some time from application because of the volatile nature of perfume, in which case the portable container 100 according to one exemplary embodiment may be refilled with the liquid perfume from the large-capacity main bottle and carried around.

The first container 110 and the second container 120 are held together to form a watertight seal and open towards each other, one of which forms a receptacle space for holding contents and the other one is moved in one direction to generate a negative pressure in the receptacle space. Thus, they can be refilled by the generated negative pressure.

In one embodiment, after contents are introduced into one of the first container 110 and second container 120, the other one may be moved in the opposite direction to generate a positive pressure in the receptacle space.

In one embodiment, the second container 120 may be attached to the top of the first container 110 in a watertight way so as to allow the relative movement of the first container 110 and the second container 120. A variety of methods may apply to the relative movement and attachment between the first container 110 and the second container 120. Here, the first container 110 may be an outer container which is positioned externally, and the second container 120 may be an inner container which is positioned internally. On the contrary, the first container 110 may be positioned internally, and the second container 120 may be positioned externally.

Like a typical liquid container, the first container 110 has a space for holding liquid inside, and may have an open end for inserting the second container 120.

The second container 120 is a component attached to the top of the first container 110 in a watertight way to allow relative movement, and therefore may be configured in various ways. In one embodiment, the second container 120 is a cylindrical member that is inserted through the top of the first container 110, and the inner surface of the first container 110 and the outer surface of the second container 120 may be tightly attached together so that the second container 120 is inserted into the first container 110 in a watertight way. Here, the second container 120 is configured in such a way that the end to be inserted into the first container 110 is open. Since the second container 120 is open at the insertion side, that is, the bottom of the second container 120 with reference to FIG. 6, the second container 120 and the first container 110 form a single receptacle space. Thus, the second container 120, which is similar to an injector in that it uses negative pressure but different in that it operates by a piston action, serves as a contents receptacle space too. As such, the portable container 100 according to the present disclosure allows for minimizing the overall volume while expanding the contents receptacle space.

A locking protrusion 210 is formed on the inner container, which is one of the first and second containers 110 and 120, and protrudes toward the outer container and a moving guide 220 having the shape of a longitudinal groove is formed on the outer container, which is the other one, to guide the movement of the locking protrusion 210. Here, the locking protrusion 210 and the moving guide 220 are components for fixing the relative movement of the first container 110 and the second container 120, and may be configured in various fashions.

For example, the locking protrusion 210 may protrude from the outer surface of the second container 120 toward the first container 110, and the moving guide 220 may form a movement path for the locking protrusion 210 on the outer surface of the first container 110 and guide the relative movement of the second container 120. In this case, the first container 110 has an assembly guide 230 that is formed toward an opening inside, in order to insert the locking protrusion 210 when being attached to the second container 120.

The moving guide 220 comprises a guide member 221 that penetrates the outer surface of the first container 110 and is formed in the shape of a straight line in the direction in which the first container 110 and the second container 120 are inserted or pulled out, a negative pressure fixing guide member 222 formed in a curve along a given length from an end of the guide member 221, and a positive pressure fixing guide member 223 formed in a curve along a given length from the other end of the guide member 221. Here, the negative pressure fixing guide member 222 is formed in a curve on the top of the guide member 221, and the positive pressure fixing guide member 223 is formed in a curve on the bottom of the guide member 221. In one embodiment, the moving guide 220 may be Π-shaped, as illustrated in FIG. 7. In another embodiment, the moving guide 220 may be a combination of an L-shape and an inverted L-shape, as illustrated in FIG. 8.

The guide member 221 is a component along with the locking protrusion 210 moves in the lengthwise direction of the first container 110, and may be formed in a straight line and guide the second container 120 to move up and down linearly.

The moving guide 220 allows the locking protrusion 210 to slide into the negative pressure fixing guide member 222 via the guide member 221 and fix the generated negative pressure. The moving guide 220 allows the locking protrusion 210 to slide into the negative pressure fixing guide member 223 via the guide member 221 and fix the positive pressure.

A watertight sealing member 240 may be included between the first container 110 and the second container 120 to prevent leaks of the refill contents by a watertight seal.

The watertight sealing member 240 may be configured as an O-ring. In one embodiment, the watertight sealing member 240 may be fitted between ring mounting bosses formed on the outer surface of the second container 120, and may be tightly attached to the first container 110 in a watertight way when the second container 120 is inserted into or pulled out from the first container 110.

The contents are introduced by a negative pressure, which is generated when the first container 110 are the second container 120 are pulled out while held together to form a watertight seal by the watertight sealing member 240. A positive pressure is generated when the first container 110 and the second container 120 are restored by being inserted in a watertight way in the reverse direction of the negative pressure generation.

A pump unit 130 is attached to one of the first and second containers 110 and 120, and the contents may be released through a nozzle 131 on the pump unit 130. In one embodiment, the pump unit 130 may comprise a nozzle 131, a micro pump 133, and a suction pipe 135. The pump unit 130 is mounted above the second container 120, and sucks up the refill contents in the receptacle space of the first container 110 and second container 120 through the suction pipe 135 by the pumping action of the micro pump 133 and sprayed out through the nozzle 131. The pump unit 130 may release the contents held inside by pumping as much as are introduced into the receptacle space from the outside. In this case, the pump unit 130 may be configured to enable the two-way exchange of material between the receptacle space and the outside, as well as releasing material from the receptacle space only in one direction. That is, the pump unit 130 may release the rise in internal pressure from the receptacle space by pumping so that the internal pressure matches the external atmospheric pressure. The pump unit 130 is attached to the second container 120.

A one-way valve 140 is attached to the other one of the first and second containers 110 and 120. The one-way valve 140 is opened only in one direction and allows the refill contents to be introduced by the negative pressure generated in the receptacle space of the first container 110 and second container 120. In one embodiment, the one-way valve 140 may protrude from the underside of the first container 110 and be connected to a main body stem holder to let in the refill contents stored in the refill liquid storage container. Also, the one-way valve 140 may be assembled in a modular fashion and attached to the first container 110.

Figure 9:
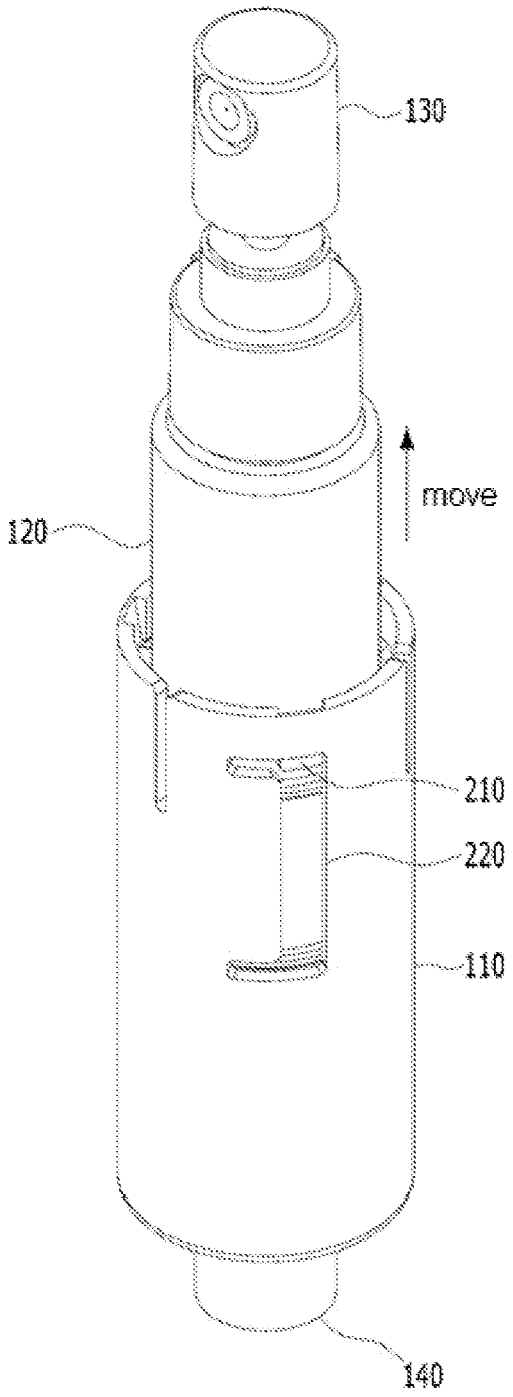
FIG. 9 is a perspective view depicting a portable container with a refill structure when it generates a negative pressure, according to one exemplary embodiment of the present disclosure.
Figure 10:
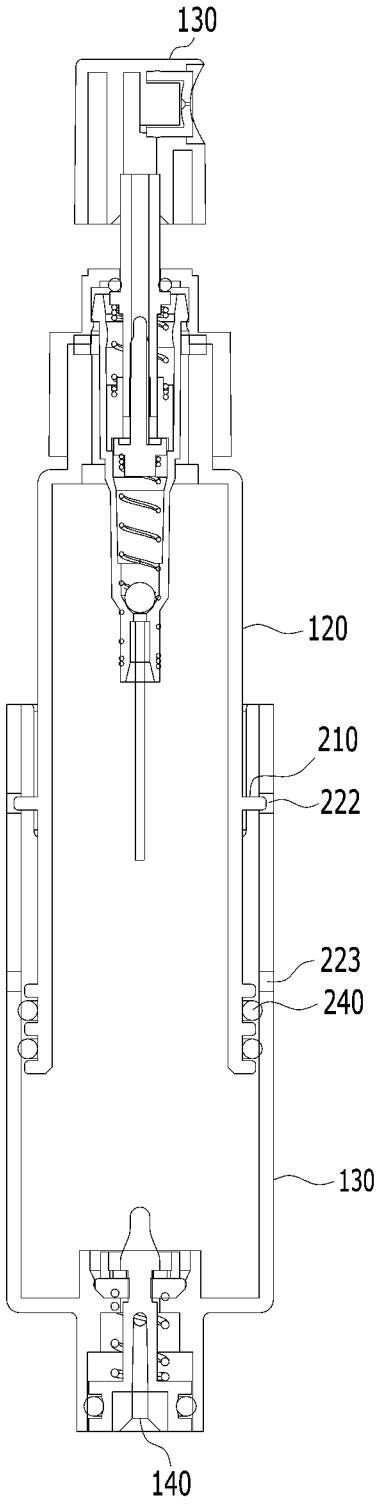
FIG. 10 is a front cross-sectional view depicting the portable container of FIG. 9 when it generates a negative pressure.

FIG. 9 is a perspective view depicting a portable container with a refill structure when it generates a negative pressure, according to one exemplary embodiment of the present disclosure. FIG. 10 is a front cross-sectional view depicting the portable container of FIG. 9 when it generates a negative pressure.

Referring to FIG. 9 and FIG. 10, the portable container 100 may generate a negative pressure in the receptacle space to refill the receptacle space with the contents from the outside through the one-way valve 140. The portable container 100 may generate a negative pressure in the receptacle space because the first container 110 and the second container 120 move variably relative to each other. The first container 110 and the second container 120, while forming one connected receptacle space, may operate in such a way as to decrease or increase the volume of the receptacle space by their relative movement. As such, a negative pressure may be generated in the receptacle space when the volume of the receptacle space is increased by the relative movement, and a positive pressure may be generated due to an increase in the pressure in the receptacle space when the volume of the receptacle space is decreased.

As illustrated in FIG. 9, when the second container 120, which is the inner container, is pulled out from the first container 110, the locking protrusion 210 protruding from the second container 120 moves along the guide member 221 of the moving guide 220 formed on the first container 110, which is the outer container. At this point, as illustrated in FIG. 10, a pressure lower than the atmospheric pressure, that is, a negative pressure, is generated inside the receptacle space as the volume of the receptacle space is increased. As the locking protrusion 210 slides into the negative pressure fixing guide member 222 and fixes the attachment between the first container 110 and the second container 120, the negative pressure generated in the receptacle space is fixed, thus refilling the receptacle space through the negative pressure.

The one-way valve 140 protruding outward from the first container 110 may be connected to the main body stem holder to open the one-way valve 140, and the refill contents stored in the refill contents storage container is introduced into the receptacle space through the open, one-way valve 140, thus refilling the receptacle space.

After refilling, when the expanded volume of the receptacle space goes back to the original volume as the second container 120 is inserted into the first container 110, a positive pressure is generated in the receptacle space. The positive pressure generated in the receptacle space is fixed by locking the locking protrusion 210 to the positive pressure fixing guide member 223. At this point, the refill contents introduced by the operation of the pump unit 130 may be sprayed.

Figure 11:
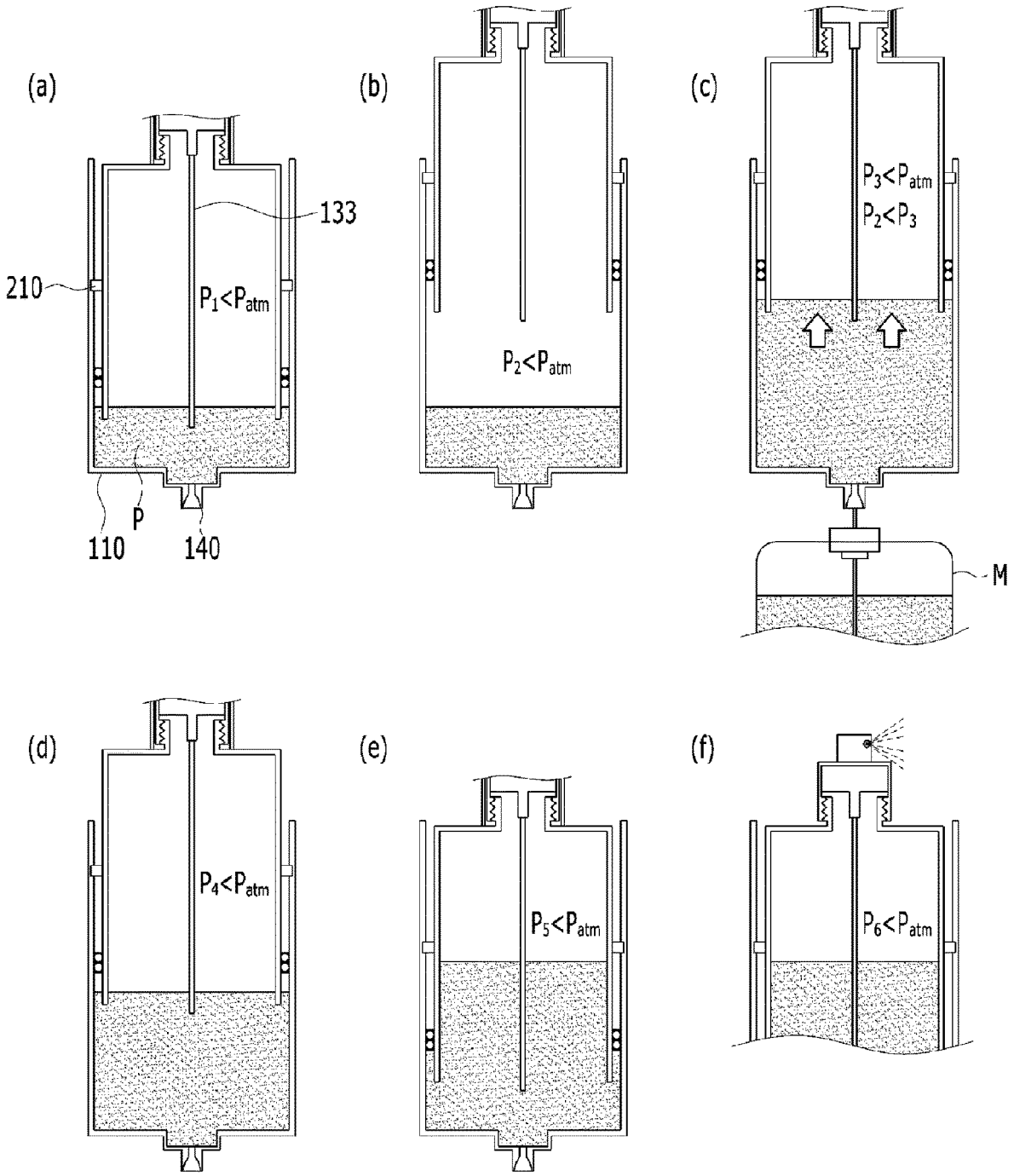
FIG. 11 is a view schematically depicting a refill process for a portable container according to one exemplary embodiment.

FIG. 11 is a view schematically depicting a refill process for a portable container according to one exemplary embodiment.

In FIG. 11, when the portable container 100 needs refilling with contents (a), the second container 120 is pulled out from the first container 110 to expand the receptacle space (b).

As shown in (b) of FIG. 11, once a negative pressure is generated by expanding the receptacle space, the locking protrusion 210 slides into the negative pressure fixing guide member 222 by turning the second container 120, so that the receptacle space is fixed in the expanded state.

Afterwards, as shown in (c) of FIG. 11, when the one-way valve 140 is connected to the main body stem holder, the refill contents P stored in the refill contents storage container M is automatically introduced into the receptacle space and refills it. That is, the negative pressure generated by the locking structure of the locking protrusion 210 and moving guide 220 is fixed, thereby automatically implementing the refill process.

Once refilling is done, the one-way valve 140 may be disconnected from the main body stem holder, and then the second container 120 may be inserted into the first container 110 by turning it backwards, as shown in (d) of FIG. 11. That way, as shown in (e) of FIG. 11, the pressure in the receptacle space is increased, and therefore a positive pressure is generated, thereby allowing the locking protrusion 210 to slide into the positive pressure fixing guide member 223 and fixing the generated positive pressure.

Thereafter, the introduced refill contents may be sprayed by the operation of the pump 130, which creates a pressure equilibrium between the inside and outside of the receptacle space, as shown in (f) of FIG. 11.

Hereinabove, although the present disclosure has been described with reference to embodiments and the accompanying drawings, the present disclosure is not limited thereto, but may be variously modified and altered by those skilled in the art to which the present disclosure pertains without departing from the spirit and scope of the present disclosure claimed in the following claims.

The invention claimed is:

1. A portable container with a refill structure, the portable container comprising:

first and second containers that are open towards each other and form a receptacle space by being inserted in a watertight way and a variable way and communicating with each other;

a one-way valve attached to the first container to allow contents to be introduced into the receptacle space; and a pump unit attached to the second container to release the contents held in the receptacle space through a nozzle, wherein a negative pressure is generated in the receptacle space by pulling out the first and second containers in the watertight way, wherein one of the first and second containers is configured as an inner container that is attached to an inside of an outer container in the watertight way, wherein another of the first and second containers is configured as the outer container attached to an outside of the inner container in the watertight way, and wherein the inner container comprises a locking protrusion protruding from an outer surface of the inner container toward the outer container.

2. The portable container of claim 1, wherein the first and second containers are configured to generate a positive pressure in the receptacle space by being inserted in the watertight way after the contents are introduced in the receptacle space.

3. The portable container of claim 1, wherein the outer container further comprises a moving guide having a shape of a longitudinal groove to guide a movement of the locking protrusion protruded from the outer surface of the inner container.

4. The portable container of claim 1, wherein the outer container comprises an assembly guide that is formed toward an opening inside of the outer container, in order to insert the locking protrusion when being attached to the inner container.

5. The portable container of claim 1, wherein the moving guide comprises:

a guide member formed in a shape of a straight line in a direction in which the inner container or the outer container is pulled out or inserted; and a negative pressure fixing guide member formed in a curve along a given length from an end of the guide member.

6. The portable container of claim 1, wherein the moving guide is configured to allow the locking protrusion to slide into the negative pressure fixing guide member via the guide member and fix the negative pressure generated in the receptacle space.

7. The portable container of claim 1, wherein the moving guide comprises:

a guide member formed in a shape of a straight line in a direction in which the inner container or the outer container is pulled out or inserted; and a positive pressure fixing guide member formed in a curve along a given length from an end of the guide member.

8. The portable container of claim 1, wherein the moving guide is configured to allow the locking protrusion to slide into the positive pressure fixing guide member via the guide member and fix a positive pressure generated in the receptacle space.

9. The portable container of claim 1, wherein the moving guide comprises:

a guide member formed in a shape of a straight line in a direction in which the inner container or the outer container is pulled out or inserted;

a negative pressure fixing guide member formed in a curve on a top of the guide member; and a positive pressure fixing guide member formed in a curve on a bottom of the guide member.

10. The portable container of claim 9, wherein the first and second containers are configured to be refilled by the negative pressure generated in the receptacle space when the locking protrusion mates with the negative pressure fixing guide member, and wherein the first and second containers are configured to spray the contents refilled in the receptacle space, via the pump unit, by a positive pressure generated in the receptacle space when the locking protrusion mates with the positive pressure fixing guide member.

11. The portable container of claim 1, wherein the one-way valve protrudes outward from the first container and is connected to a main body stem holder to let in contents stored in a refill contents storage container.

12. The portable container of claim 1, further comprising a watertight sealing member included between the first container and the second container and configured to prevent leaks of the contents stored in the receptacle space.

13. A portable container with a refill structure, comprising:

an inner container and an outer container that are held together to form a watertight seal and open towards each other, wherein one of the inner container and the outer container forms a receptacle space which stores contents therein, and another of the inner container and the outer container is configured to move in one direction to generate a negative pressure in the receptacle space such that contents at an outside of the portable container are introduced into the receptacle space by the negative pressure and move in another direction opposite to the one direction to generate a positive pressure in the receptacle space, wherein the inner container comprises a locking protrusion protruding from an outer surface of the inner container toward the outer container, wherein the outer container comprises a moving guide having a shape of a longitudinal groove to guide a movement of the locking protrusion formed on the outer surface of the inner container, and wherein the locking protrusion is configured to mate with the moving guide at a top or a bottom of the moving guide such that the negative pressure or the positive pressure generated in the receptacle space is fixed.

14. The portable container of claim 13, further comprising:

a one-way valve attached to the one of the inner container and the outer container, which forms the receptacle space, the one-way valve configured to allow the contents to be introduced into the receptacle space; and a pump unit attached to the another of the inner container and the outer container and configured to release the contents stored in the receptacle space through a nozzle.

* * * * *